US005114140A

United States Patent [19]

Barr

[11] Patent Number: 5,114,140

[45] Date of Patent: May 19, 1992

[54] EXPLOSION SIMULATOR

[75] Inventor: Craig K. Barr, Tujunga, Calif.

[73] Assignee: Universal City Studios, Inc., North Hollywood, Calif.

[21] Appl. No.: 658,385

[22] Filed: Feb. 20, 1991

[51] Int. Cl.[5] ..... A63J 5/02

[52] U.S. Cl. ..... 472/75; 40/410; 472/65; 472/82

[58] Field of Search ..... 272/8 R, 8 D, 8 N, 9, 272/11, 15, 20, 21, 25, 26; 40/410, 430, 431, 502

[56] References Cited

U.S. PATENT DOCUMENTS

| | | | |
|---|---|---|---|
| 498,668 | 5/1893 | Lytell | 272/26 |
| 643,493 | 2/1900 | Fuller | 272/15 |
| 3,415,513 | 12/1968 | Burnbaum | 272/15 |
| 3,432,439 | 3/1969 | Dickman | 272/15 X |
| 3,903,628 | 9/1975 | Goyeau | 272/15 X |
| 4,028,830 | 6/1977 | Ottinger | 272/15 X |

*Primary Examiner*—Richard E. Chilcot, Jr.
*Attorney, Agent, or Firm*—Lyon & Lyon

[57] ABSTRACT

An underwater explosion effect simulator includes a submerged shooter for shooting props and dye-colored water through the water surface. A compressed air source is linked to the shooter to drive the charge of water from the shooter during the explosion sequence. Prop pieces are ejected from the shooter through the water surface and trajectories over a submerged collector substantially surrounding the shooter. The collector is displaceable through an underwater winching system from a collect position wherein the props settle onto the collector to a funnel position wherein the props fall under gravity into the shooter. The shooter extends from a loading position below the collector to a shooting position close to the water surface.

13 Claims, 6 Drawing Sheets

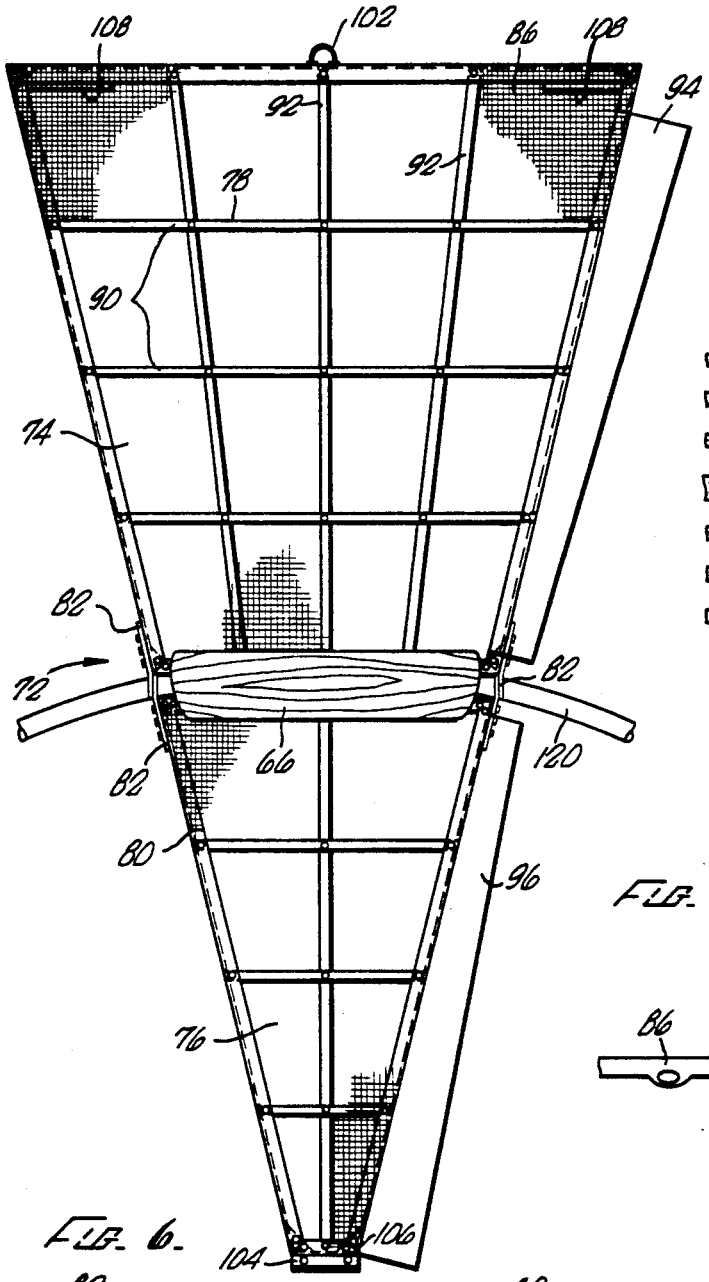
FIG. 3.
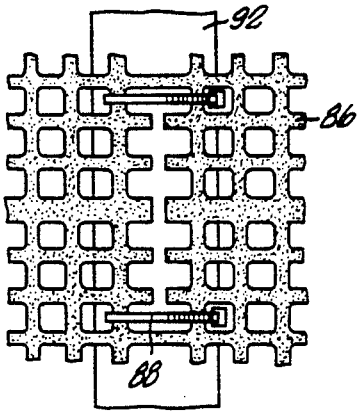
FIG. 4.
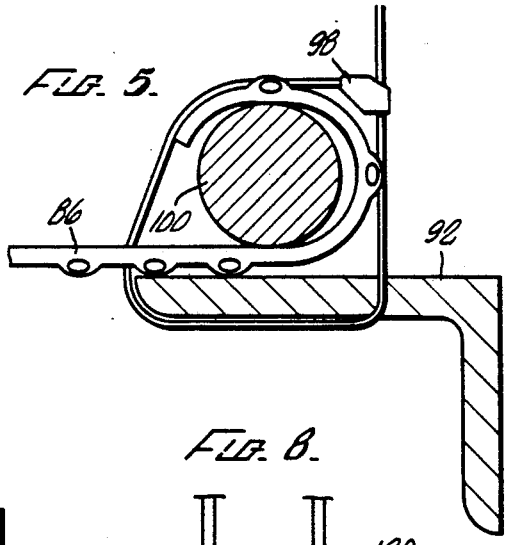
FIG. 5.
FIG. 6.
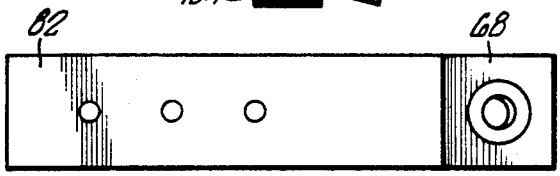
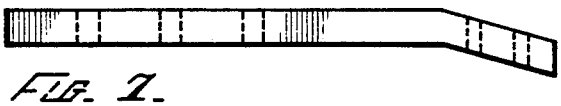
FIG. 7.
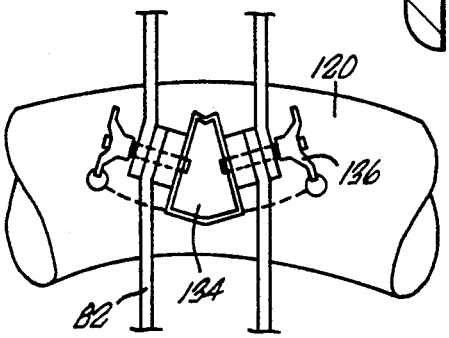
FIG. 8.

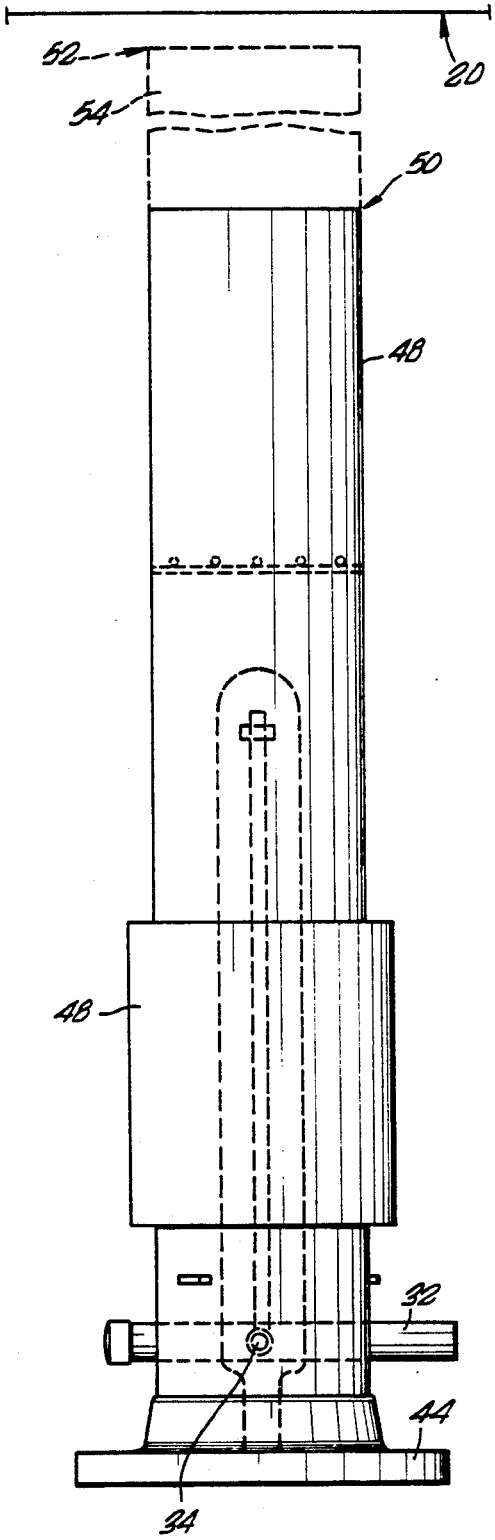
FIG. 9.
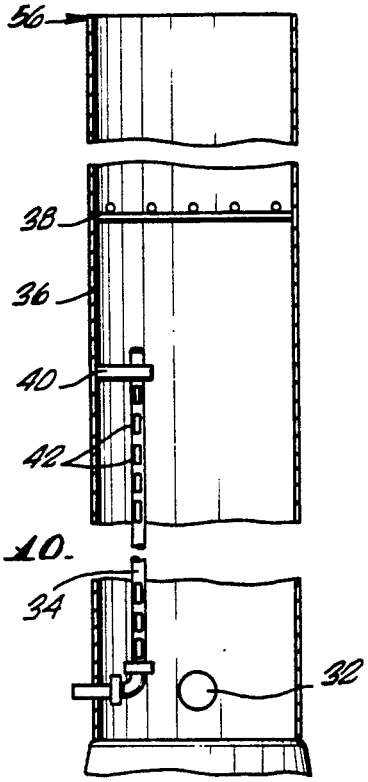
FIG. 10.
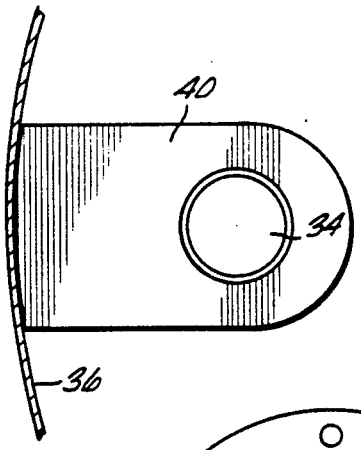
FIG. 11.
FIG. 12.
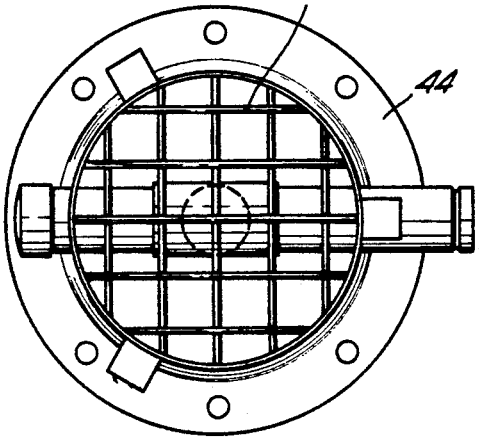

EXPLOSION SIMULATOR

BACKGROUND OF THE INVENTION

The invention relates to explosion simulation.

Various devices have been known in the past for creating special effects in an amusement or theme park setting. Known explosion effects have been generated using for example, pyrotechnics or compressed gases. In addition, various underwater special effects may be generated using air bubbles, special lighting, and mechanical props. However, in a theme park setting, an explosion special effect simulation must often be achieved repeatedly on a high duty cycle. Consequently, the effect simulation machinery must not only create a vivid and realistic special effect, but it must also be able to rapidly prepare or reset for the next special effect cycle. Where the special effect simulation includes an explosion with the scattering of debris or props, as far as is known repeated operation without extensive human intervention has not heretofore been feasible.

Accordingly, it is an object of the invention to provide a novel explosion effect simulator.

It is a further object of the invention to provide an underwater explosion effect simulator which shoots out prop pieces and spray from below the water surface and subsequently automatically collects the pieces for reloading.

It is a further object of the invention to provide such a device which creates a dramatic and vivid appearance of an underwater explosion and disintegration of an underwater prop, such as a mechanical shark.

It is yet another object of the invention to provide such a device which temporarily creates the appearance of blood in the water, and then removes the blood appearance prior to the next cycle of the device.

SUMMARY OF THE INVENTION

An underwater explosion effect simulator has a submerged shooter for shooting a mixture of props and dye colored water. An air tank is provided to charge the shooter. A submerged collector substantially surrounds the shooter for collecting the props as they fall back from their trajectories above the water and then sink downwardly from the water surface. The submerged collector is tethered to float below the water surface. A winch system winches the collector from a collecting position to a funnel position to assist in causing the projectile props to tumble down on the collector, to reload the shooter.

Preferably, the collector includes a plurality of overlapping sectors or leaves, with each leaf having a generally triangular shaped inner section and a generally trapezoidal shaped outer section. These sections are pivotally linked together through pivot arms attached to a net ring. Floats are attached to the outer sections of the leaves which are held in a substantially stationary vertical position under the water by cables or tethers linking them to the bottom floor of a lagoon. A float ring is preferably attached to the net ring to provide buoyancy. An on shore controller controls the shooter and collector winching system. Most desirably, the shooter has a barrel extension movable from a reload position wherein the top opening of the shooter is at the bottom of the collector, to a shooting position adjacent the water surface and several feet above the reload position.

A blood effect simulator includes a shooter positioned below the water surface in a lagoon, for shooting a charge of dye-colored water from below the water surface. The water charge is driven by compressed air in a compressed air tank linked to the shooter. After the charge has been shot out of shooter and dispersed in the lagoon and the effect completed, bromine and air bubbles are diffused into the lagoon from a bromine distribution grid generally positioned around the shooter. The bromine reacts with the dye-colored water and renders it colorless, to prepare the lagoon for the next cycle.

BRIEF DESCRIPTION OF THE DRAWINGS

Other objects and features of the present invention will become apparent from the following detailed description taken in connection with the accompanying drawings. It is to be understood, however, that the drawings are designed for the purpose of illustration only and are not intended as a definition of the limits of the invention.

In the drawings, wherein similar reference characters denote similar elements throughout the several views:

FIG. 3 is a top elevation view of a panel of the collector shown in FIG. 1;

FIG. 4 is a top elevation view fragment showing a construction detail of the panel of FIG. 3;

FIG. 5 is a section view fragment of the panel of FIG. 3;

FIG. 6 is a top elevation view of the pivot arms of the panel of FIG. 3;

FIG. 7 is an end view thereof;

FIG. 8 is an enlarged top elevation view fragment of the pivot arms of the collector attached to the net ring;

FIG. 9 is a perspective view of the shooter of FIG. 1 with an alternate position of the barrel extension shown in phantom lines;

FIG. 10 is a side elevation view fragment of the shooter of FIG. 8;

FIG. 11 is an enlarged end view fragment in part section thereof;

FIG. 12 is a top elevation view of the shooter of FIG. 9;

FIG. 15 is a construction detail of the bromine and air piping of the system of FIG. 13.

DETAILED DESCRIPTION OF THE DRAWINGS

Figure 1:
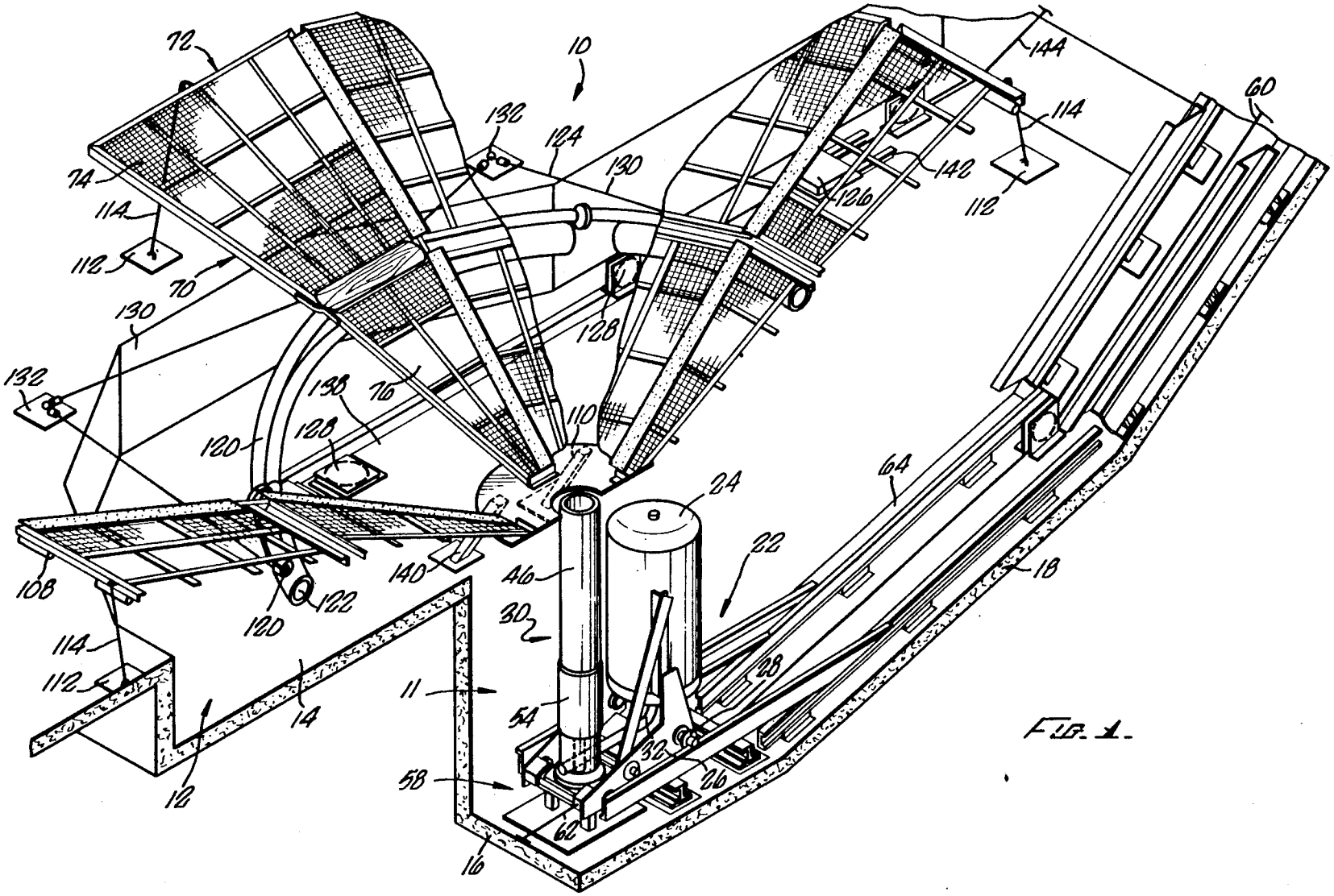
FIG. 1 is a perspective view fragment of the present underwater explosion effect simulator.

As shown in FIG. 1, a special effects simulation apparatus 10 is positioned within a pit or trough 11 in a water-filled lagoon 12 having a bottom 14 and a foundation 16, e.g., of concrete construction. From the water surface or waterline 20 (FIG. 2), the walls 18 of the lagoon 12 around the apparatus 10 are inclined downwardly.

A blast generator generally designated as 22 includes an air tank 24 mounted on a dolly frame 26 having wheels 28. The blast generator 22 includes a shooter 30 having a shooter barrel 46 and a barrel extension 54. A connection pipe 32 connects the tank 24 to the shooter 30.

The dolly frame 26 supporting the blast generator 22 rests on guide rails 64 which extend from the operating location 58 of the blast generator 22 up the sloping sides 18 of the lagoon 12. A hoist line 60 running from the dolly frame 26 to an on-shore winch adjacent to the lagoon 12 allows the blast generator 22 to be pulled up and out of the lagoon 12 for service or maintenance. A control cable 62 connects the blast generator 22 to an onshore controller.

A collector generally designated by 70 surrounds the shooter 30 for collecting and recycling prop pieces ejected by the shooter. The collector 70 has radially mounted leaves 72. Preferably, 12 leaves 72 are used in the approximately 30 foot diameter collector 70. Secondary shooters 140 are placed around the shooter 30. Underwater lighting 146 is mounted on the centerplate 110 adjacent the shooter 30.

FIGS. 9–12 show the details of the shooter 30. Referring to FIG. 10, a blood tube 34 having openings 42 extends vertically within the shooter 30. The blood tube 34 is supported within the blood tube 34 by a flange support 40 attached to the inside of the cylindrical wall 30 of the shooter 30. A grate 38 is positioned within the shooter 30 above the blood tube 34 and below the top end 56 of the shooter 30. A cylindrical mounting base 44 on the shooter 30 has holes for bolting the shooter to the dolly frame 26. A barrel extension 54 is slidably yet sealably attached to the shooter 30 The barrel extension is driven between a reload position 50 and a shoot position 52 using compressed air. Various alternative known mechanisms and structures are also available for extending the barrel extension 54 (e.g. telescopically) between positions 50 and 52, for example, a rack and pinion drive.

FIGS. 3–11 illustrate the detailed construction of the collector 70. Referring to FIG. 3, each leaf 72 includes an upper section 74 and a lower section 76. The upper and lower section 74 and 76 have upper and lower structural lattices 78 and 80, made of fiberglass cross beams 90 attached to radial supports 92. Stretched entirely across the structural lattices 78 and 80 is netting material 86. As shown in FIG. 4, cable ties 88 fasten the netting material 86 over a radial support 92 of the structural lattice. A diaphragm or bridging plate 66 flexibly bridges the gap between the lower section 76 and upper section 74. Floats 108 are attached to the wider end of each upper section 74.

Overlap panels 94 and 96 are attached along one side of the upper and lower sections 74 and 76 and extend over the adjacent panels. The overlap panels are preferably made of 0.06 thick ABS.

As shown in FIG. 5, along the radial edges of the upper and lower sections 74 and 76, the netting material 86 is fastened to the radial supports 92 by wrapping the netting material 86 around a ⅜" dia. PVC rod 100 using a cable tie 98. A hold down 102 is centrally attached to the upper section 74. An attachment toe 104 is attached through a hinge 106 to the narrow end of the lower section 76.

Referring to FIGS. 3, 6, 7 and 8, steel pivot arms 82 having a tab 68 are attached to the upper and lower sections 74 and 76. The tabs 68 on the pivot arms 82 on the upper section 74 flare outwardly whereas the tabs on the pivot arms on the lower section 76 flare inwardly. A tubular steel net ring 120 has leaf mounting stanchions 134 spaced around its circumference on the top surface of the ring. Fasteners 136 pass through the tabs 68 of the pivot arms 82 to pivotally attach the upper and lower sections 74 and 76 to the net ring 120, as shown in FIG. 8. The net ring 120 is preferably made of 4" diameter stainless steel tubing with the ring diameter approximately 16 feet.

Figure 2:
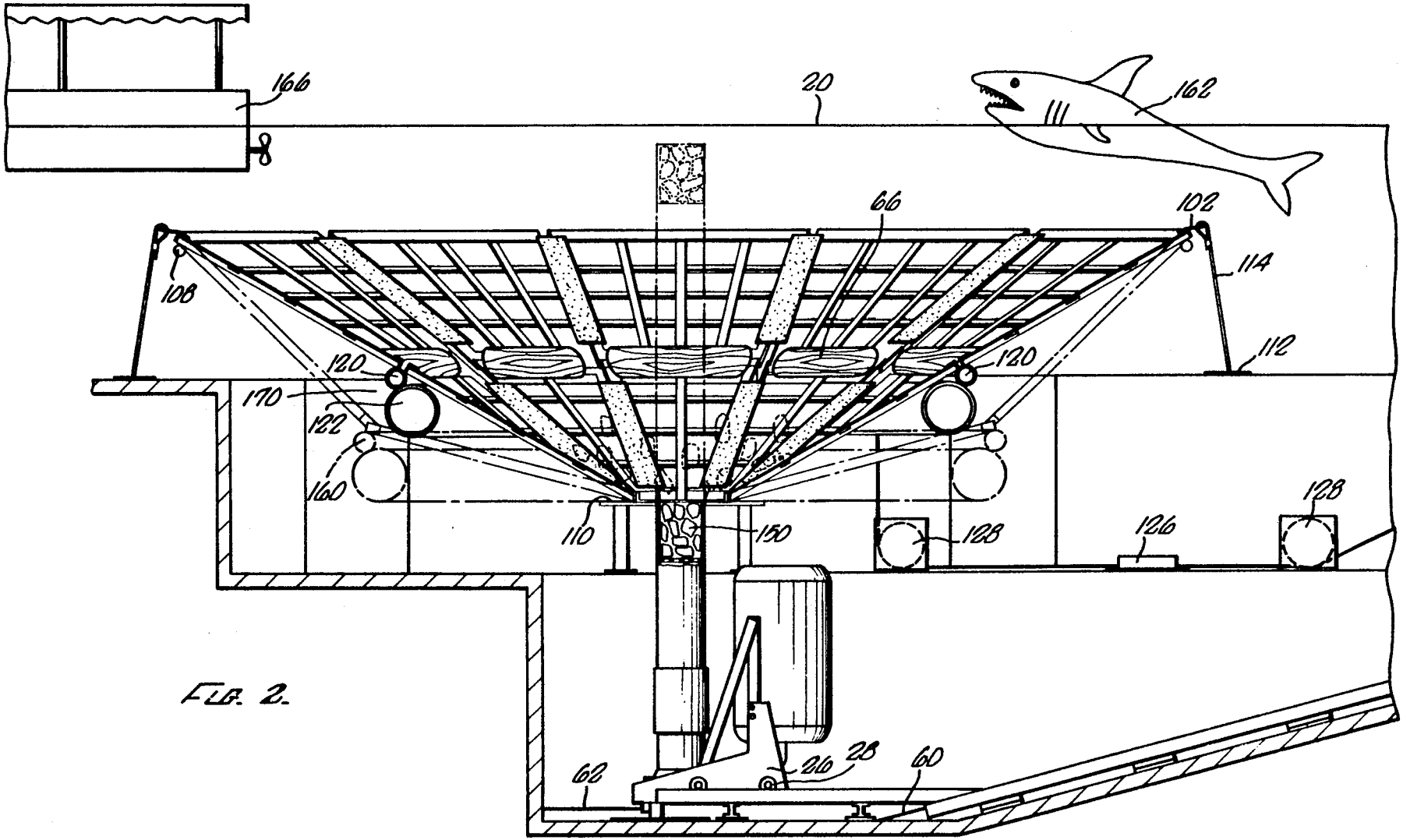
FIG. 2 is a side elevation view thereof.

Referring to FIGS. 1 and 2, the attachment toes 104 of the leaves 72 of the collector 70 are bolted to a centerplate 110 surrounding the shooter 30, such that the leaves 72 can swing or pivot up about the hinges 106.

A tether cable 114 is attached to the hold down 102 on each leaf 72 and extends down to its collector tether plate 112 fastened to the bottom 14 of the lagoon 12. The tether cables 114 have a predetermined length such that the upper sections 74 of the leaves 72 remain relatively fixed in a position below the water surface 20. The upper section floats 108 keep the tethers 114 taut.

A float ring 122 is attached to the underside of the net ring 120. The float ring 122 is hollow and filled with air or a buoyant material such as styrofoam and accordingly is highly buoyant. A winching system generally designated by 124 is used to winch down the float ring 122 to move the collector 70 from a collect position 160 as shown in phantom lines in FIG. 2, to a funnel position 170 as shown in solid lines in FIG. 2. The winching system 124 includes winch cables 130 extending from the float ring 122 to four equally spaced apart winch system anchors 132 attached to the bottom 14 of the lagoon 12. The winch cables 130 are attached to primary cables 138 which are guided by sheaves 128. The four primary cables terminate in a winch block 126 slidably positioned on winch rails 142. A drive cable 144 extends from the winch block 126 through a side wall of the lagoon to an on-shore winch adjacent the lagoon.

Figure 13:
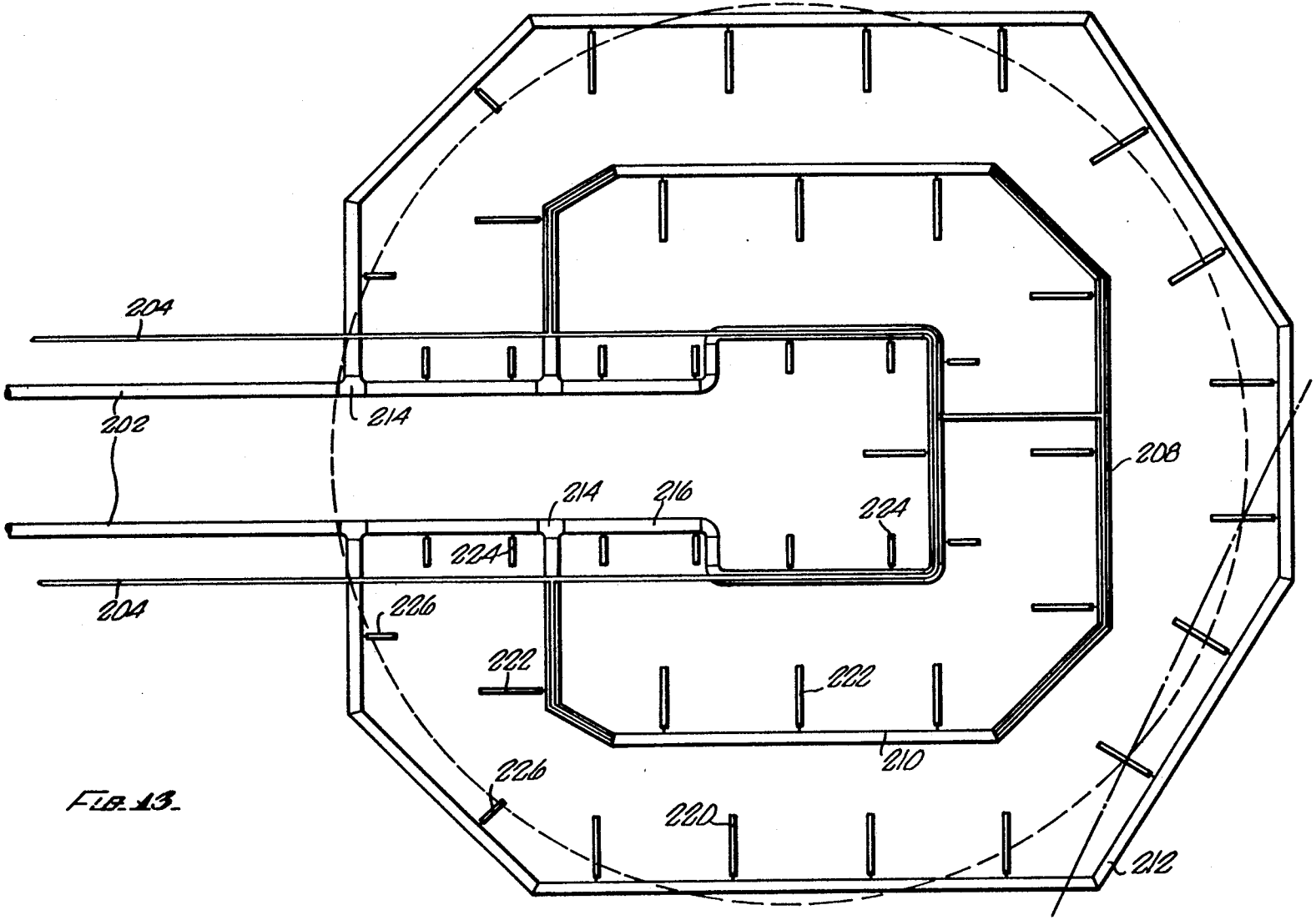
FIG. 13 is a top elevation view of the blood dye bromine diffuser system.

FIG. 13 illustrates the bromine diffuser system 200 surrounding the shooter 30 and underlying the collector. A pair of 4 inch stainless steel air pipes 202 extend from an on-shore compressed air source to the diffuser system 200. Similarly, a pair of 3 inch CPVC bromine supply pipes 204 connect an on-shore bromine supply to the diffuser system 200. The air supply pipes 202 form an inner ring 208, middle ring 210, and an outer ring 212 of the diffuser system 200. The inner, middle and outer rings are connected by bridge pipes 216 and t-sections 214. The bromine supply pipe 204 tapers from a 3 inch diameter to a 2 inch diameter bromine header which overlies the inner ring 208 on three sides, and the middle ring 210 on two sides, as shown in FIG. 13. The bromine header 218 is made of a 2 inch diameter CPVC pipe having spaced apart ½ inch diameter holes 218, to permit the release and diffusion of bromine. The bromine header 218 is strapped over the air supply pipes 202, as shown in FIG. 15.

Figures 14, 16:
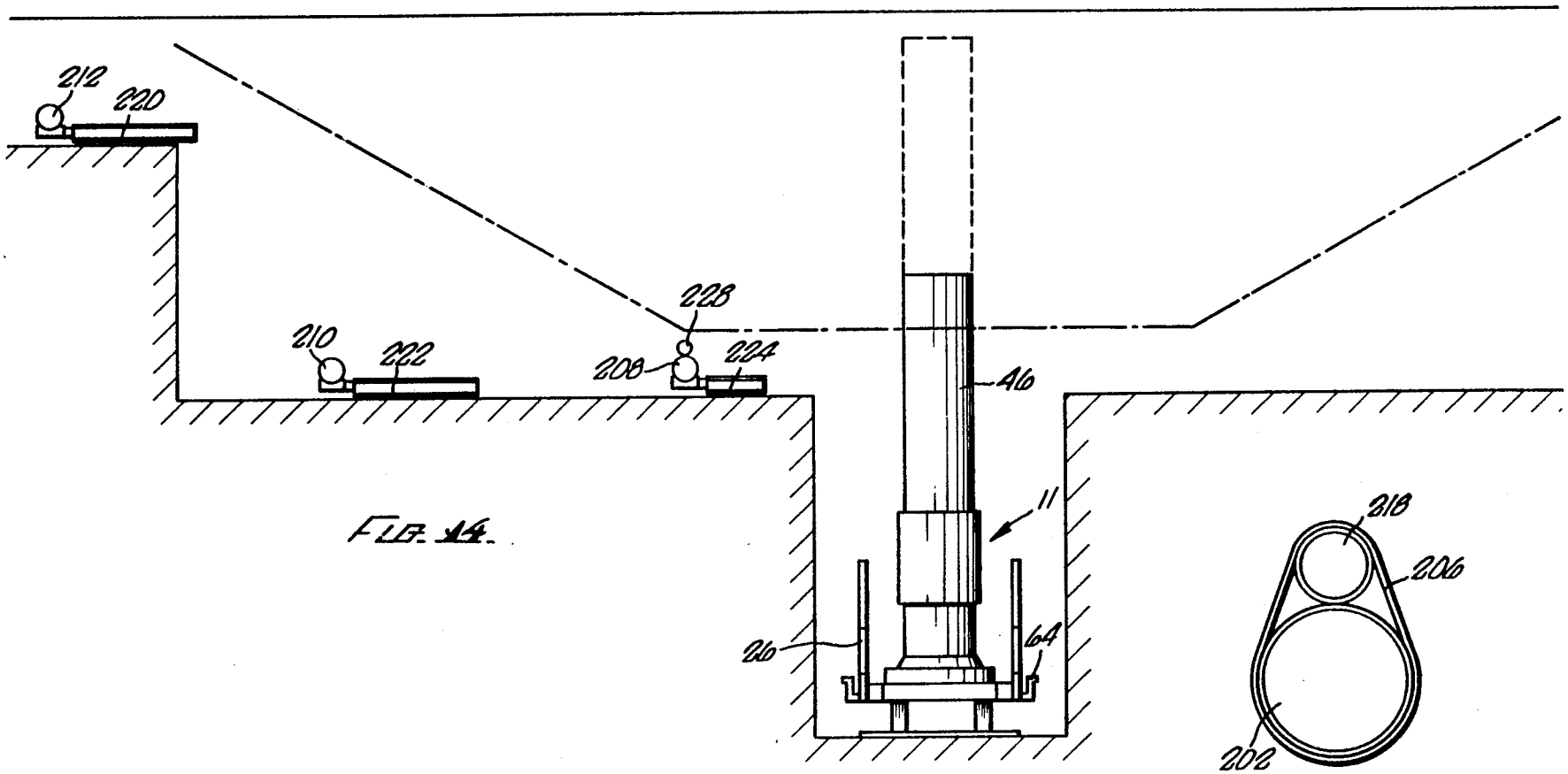
FIG. 14 is a side view fragment in part section thereof.

Extending inwardly from the outer ring 212 are a series of spaced apart air diffusers 220. These diffusers are approximately 2 feet long with 5/16 diameter holes. The outer ring 212 also has 4 side air headers 226, which are 1 foot long with ¼ inch holes, on the side adjacent to the supply lines. Extending outwardly from the middle ring 220 are middle ring air headers 222 which are 2 feet long with ¾ inch holes. Two additional middle ring air diffusers 222 extend outwardly and parallel to the supply lines. Extending inwardly from the inner ring 208 are inner ring air headers 224 which are 1 foot long with ½ inch diameter holes. Similar air headers 224 extend outwardly from the bridge pipes 216, as shown in FIG. 13. The headers are shown on one side only in FIG. 14 for clarity of illustration. The arrangement of the rings and headers provides proper diffusion of bromine and air.

In operation, the simulation apparatus 10 simulates an underwater explosion and destruction of an underwater prop, e.g., a mechanical shark in a theme park setting. Referring to FIG. 2, the simulation apparatus 10 is shown in phantom lines in the ready to shoot condition. Specifically, sufficient prop pieces 150 are collected and are resting on the grate 38 in the shooter 30 such that the barrel extension 54 is substantially filled with prop pieces. The barrel extension elevator 48 has elevated the barrel extension 54 to the shoot position 52, approximately 3-8 inches and preferably 6 inches below the water line 20. The blood tube 34 has diffused blood red dye into the water filling the shooter 30. The air tank 24 is charged with compressed air. The collector 70 has been winched down by the winching system 124 to the collect position 160.

The prop pieces 150 are heavier than water and have a texture and color scheme to simulate shark flesh.

Based on the theme of the motion picture "JAWS" distributed by Universal Studios, Universal City, Calif., a mechanical shark prop 162 moves through the lagoon 12 on a mechanical linkage. A passenger boat 166 travels along a predetermined course 164 in the lagoon. After attacking a passenger boat 166 which passes near the apparatus 10, the mechanical shark 162 swallows or is hit with an explosive thrown or shot by the operator of the passenger boat 166. The mechanical shark 162 submerges adjacent to the simulation apparatus 10 and continues on a predetermined underwater path moving away from the apparatus 10. The simulation apparatus is preferably sufficiently below the water level 20 so that it is not visible by the passengers on the boat 166. Momentarily after the mechanical shark 162 submerges, the simulation apparatus is activated in timed sequence by on-shore controllers.

Specifically, a valve in the connection pipe 32 opens. Compressed air in the air tank 24 drives a charge of water explosively upwardly from the barrel extension of the shooter 30. The charge carries the red-dyed water and prop pieces 150 in the shooter 30 upwardly through the water surface 20 creating a plume of "blood", water, spray and "shark flesh", which is visible to the passengers on the boat 166. Simultaneously, the secondary shooters 140 shoot secondary blasts of water through the surface 20, and the underwater lighting 146 flashes on, to enhance the visual effect.

The passengers on the boat 166 perceive an apparent underwater explosion and disintegration of the submerged shark, whereas the actual mechanical shark 162 has moved underwater and unseen away from the area. As the passenger boat 166 moves along its course in the lagoon 12 taking it away from the simulation apparatus 10, the barrel extension elevator 48 lowers the barrel extension 54 to the reload position 50, as shown in solid lines in FIGS. 2 and 9. The prop pieces 150 having fallen back to the water surface 20 sink onto the collector 70. Some of the prop pieces 150 may tumble down the incline of the collector 70 on their own. Other pieces may remain on the collector 70. Accordingly, the winching system 124 is reversed or released allowing the lower sections of the collector 70 to float up from the collect position 160 to the funnel position 170 as shown in solid lines FIG. 2. The steeper incline of the collector 70 in the funnel position 170 causes remaining prop pieces 150 to tumble downwardly towards the center of the collector 70 and into the shooter 30, to reload the shooter. Sufficient prop pieces 150 are provided so that even with the shooter fully loaded, extra prop pieces remain around the base of the collector 70. This helps to insure that the shooter will consistently have a full load of prop pieces 150. The winching system 124 winches the collector 70 back to the collect position 160, while the air tank 24 is recharged with compressed air and dye is dispersed from the blood tube 34 into the water refilling the shooter 30. The ability of the collector 70 to convert between the collect position and load position allows the collector to function effectively in a relatively shallow depth. This also reduces the required travel of the barrel extension.

The water in the lagoon 12 is substantially still, the lagoon 12 having no significant currents, tides or waves. During the explosion sequence, the red blood dye shot from the shooter 30 colors the water over the diffuser 200. As the passenger boat 166 moves away from the operating location 58, the diffuser 200 is activated by pumping compressed air through the air pipes 202 and by pumping bromine through the bromine supply pipes 204. Air bubbles out of the various air headers and bromine flows out of the spaced apart openings in the bromine supply lines 218. The bromine diffuses into the water in the region over the diffuser 200 and together with the air bubbles reacts with the blood dye to render it colorless, in preparation for the next cycle.

The simulation apparatus 10 is then ready for the next cycle, which may occur at intervals as frequent as 70 seconds.

Thus, while other modifications and embodiments may be apparent to those skilled in the art, it should be appreciated that the invention is susceptible to variation and change without departing from the proper spirit and scope of the following claims.

What is claimed is:

1. An underwater explosion effect simulator comprising:

a submerged shooter for shooting a plurality of props;

means for repeatably charging the shooter;

a submerged collector substantially surrounding the shooter; and means for alternating the collector from a collect position wherein the props settle onto the collector, to a funnel position wherein the props fall under gravity towards the shooter.

2. The effect simulator of claim 1 wherein the collector comprises a plurality of overlapping sectors with each sector having a generally triangular shaped inner section and a generally trapezoidal shaped outer section pivotally linked to the inner section at pivot points.

3. The effect simulator of claim 2 wherein the simulator is positioned in a lagoon having a floor, further comprising floats attached to the outer sections and tether linking the outer sections to the lagoon floor.

4. The effect simulator of claim 3 further comprising a float ring attached to the collector at the pivot points.

5. The effect simulator of claim 4 wherein the means for alternating comprises a winching system attached to the float ring, the winching system shifting the collector between the collect and funnel positions by raising and lowering the float ring.

6. The effect simulator of claim 1 wherein the means for charging comprises at a tank linked to a compressed air source and to the shooter.

7. The effect simulator of claim 1 further comprising means for changing the position of the shooter from a loading position to a shooting position.

8. The effect simulator of claim 7 wherein the shooter is positioned in a trough in the lagoon.

9. A blood effect simulator comprising:

a shooter positioned below a water surface in a lagoon for shooting a charge of dye-colored water from below the water surface;

means for repeatably charging the shooter with dye-colored water;

an air/bromine distribution grid generally positioned around the shooter for diffusing air and bromine into the lagoon to render the dye-colored water colorless.

10. The simulator of claim 9 further comprising a controller for controlling the timing and duration of diffusion of bromine from the bromine distribution grid.

11. A special effects attraction comprising:

a lagoon having a floor and filled with water to an operating level;

a shooter supported on the floor;

a barrel extension on the shooter moveable between a shooting position adjacent the operating level and a loading position below the shooting position;

a barrel extension driver for moving the barrel extension between the shooting and loading positions;

means for projecting a charge of water and prop pieces from the shooter to create a blast spray above the operating level;

a submerged collector surrounding the shooter having inner sections hingedly joined to outer sections;

a winching system for pulling the collector into a loading position; and a controller for controlling the means for projecting, barrel extension driver and winching system.

12. The apparatus of claim 11 further comprising a grating in the shooter for supporting the prop pieces.

13. The apparatus of claim 11 wherein the means for projecting comprises a compressed air source connected to the shooter through a valve.

* * * * *